US006012671A

United States Patent [19]

Resch

[11] Patent Number: 6,012,671

[45] Date of Patent: Jan. 11, 2000

[54] TUBE FEEDING DEVICE FOR CHEESE-PRODUCING TEXTILE MACHINES

[75] Inventor: Ludwig Resch, Toging, Germany

[73] Assignee: W. Schlafhorst AG & Co., Moenchengladbach, Germany

[21] Appl. No.: 09/173,765

[22] Filed: Oct. 16, 1998

[30] Foreign Application Priority Data

Nov. 17, 1997 [DE] Germany ..... 197 50 836

[51] Int. Cl.[7] ..... B65H 5/04

[52] U.S. Cl. ..... 242/473.6

[58] Field of Search ..... 242/473.5, 473.6, 242/473.7, 473.8

[56] References Cited

U.S. PATENT DOCUMENTS

| | | | |
|---|---|---|---|
| 3,964,723 | 6/1976 | Schippers et al. | 242/473.5 |
| 4,685,283 | 8/1987 | Slavik et al. | 242/473.6 X |
| 5,083,716 | 1/1992 | Colli et al. | 242/473.6 |
| 5,175,990 | 1/1993 | Fritschi et al. | 242/473.5 X |
| 5,299,750 | 4/1994 | Nakagawa et al. | 242/473.6 |
| 5,326,039 | 7/1994 | Tanae et al. | 242/473.8 |
| 5,582,354 | 12/1996 | Peters | 242/473.6 |

FOREIGN PATENT DOCUMENTS

| | | |
|---|---|---|
| 33 18 496 A1 | 11/1983 | Germany . |
| 25 06 417 C2 | 9/1986 | Germany . |
| 0 262 726 | 4/1988 | Germany . |
| 37 19 091 A1 | 12/1988 | Germany . |
| 195 29 566 A1 | 2/1996 | Germany . |

*Primary Examiner*—Donald P. Walsh
*Assistant Examiner*—Collin A. Webb
*Attorney, Agent, or Firm*—Kennedy Covington Lobdell & Hickman, LLP

[57] ABSTRACT

A tube feeding device for cheese-producing textile machines (1), has a tube magazine (11) arranged on the end of the machine, interim tube reservoirs (9) which are part of the winding stations, and a conveying device (10) for distributing the empty tubes (8) to the interim tube reservoirs of the winding stations. The conveying device (10) comprises a track (18) which horizontally extends over the length of the machine and has spaced windows (23), along which a control strip (19), which has correspondingly spaced windows (24), is displaceably seated, as well as a tube transport carriage (20), which can be displaced between the tube magazine (11) and the interim tube reservoirs (9). The tube transport carriage (20) has a magnetically actuable tube gripper device (21), which can be positively controlled by the axial displacement of the control strip (19).

11 Claims, 6 Drawing Sheets

TUBE FEEDING DEVICE FOR CHEESE-PRODUCING TEXTILE MACHINES

FIELD OF THE INVENTION

The present invention relates to a tube feeding device for textile machines which produce packages of wound yam often referred to as cheeses or bobbins, e.g., open-end spinning frames or automatic winding machines. More particularly, the present invention relates to such cheese-producing machines having a tube magazine arranged at the end of the machine for storing empty tubes on which the yam is wound, interim tube reservoirs which are part of the individual winding stations, and a conveying device for distributing the empty tubes to the interim tube reservoirs of the winding stations.

BACKGROUND OF THE INVENTION

Various devices and methods are known in connection with such cheese-producing textile machines for supplying the multiple winding stations of these textile machines sufficiently with empty tubes which are required by the winding stations of these textile machines for producing fresh winding cheeses or bobbins.

For example, one known tube feeding device for a textile machine as described in German Patent Publication DE 25 06 417 C2, has a continuously circulating conveyor chain extending over the length of the machine, with conveying hooks on the conveyor chain for receiving empty tubes. Interim reservoirs are pivotably seated in the area of the winding stations of the textile machine to be pivoted into the transport track of the conveyor chain into a position to strip a fresh empty tube from the conveyor chain, which subsequently falls into the interim reservoir.

When required, a cheese changer servicing the winding stations removes the empty tube from the interim reservoir and transfers it into the frame of the respective spinning or winding station. Thereafter, the interim reservoir is again positioned in its empty tube receiving position in the area of the conveying track of the conveyor chain and is again filled with an empty tube. This device has been shown to be unsuitable, in particular in case of a multi-batch operation of the textile machines, and therefore has not been accepted in actual commercial use.

Tube supply installations based on European Patent Publication EP 0 262 726 A2 and German Patent Publication DE 195 29 566 A1 represent the current state of the art, and basically have the winding stations of a cheese-producing textile machine connected with a central tube magazine arranged at the end of the machine via a tube conveyor belt extending over the length of the machine. In case of a cheese change, a service unit is positioned at the respective winding station and exchanges the finished cheese against a previously requested empty tube, which had been delivered by the tube conveyor belt. The movable service units of these textile machines have manipulating devices, by means of which they can pick up empty tubes from the conveyor track and place them into the spinning frame of the spinning station.

The main disadvantage of these known devices is that the cheese changer positioned at the winding station must first wait for the arrival of a requested empty tube. The waiting times which thereby occur have a negative effect on the total efficiency of these textile machines. To avoid such waiting times, it has already been suggested in the past to provide interim reservoirs in the area of the winding stations to be supplied with empty tubes via the tube conveyor belt. The cheese changer then can take an empty tube out of these interim reservoirs at any time and can transfer it immediately into the spinning frame.

Installations, wherein the textile machines have a central tube magazine arranged at the end of the machine, are described in German Patent Publications DE 195 12 891 A1 or DE 195 21 372 A1. In these installations, the tube magazine is connected in a known manner with the interim reservoirs at the winding stations via a tube conveyor belt extending over the length of the machine. The cheese changers of these textile machines have a manipulating device for transferring the empty tubes from the tube conveyor belt to the interim reservoirs, as well as a manipulating device for picking up and transferring the empty tubes deposited in the interim reservoirs to the spinning frame of the respective spinning stations. With these known installations, a fresh empty tube is requested by the service unit immediately at the start of the cheese changing process, which is transferred to the interim reservoir of the winding station by the service unit before it leaves the winding station.

SUMMARY OF THE INVENTION

In view of the above mentioned prior art, it is a basic object of the present invention to provide an improved tube feeding device for feeding empty winding tubes for use in cheese-producing textile machines.

Briefly summarized, the present invention attains this object in a textile machine having a plurality of individual winding stations aligned with one another for producing cheeses of yam wound on supporting tubes by providing a novel arrangement for supplying empty tubes to the winding stations which basically comprises a tube magazine arranged at one end of the plural winding stations for storing empty tubes, a plurality of interim tube reservoirs each associated with a respective one of the winding stations, and a conveying device for delivering empty tubes from the tube magazine to the interim tube reservoirs of the winding stations. In accordance with the present invention, the conveying device including a tube delivery track extending essentially horizontally over the length of the machine and a control strip displaceably disposed along the delivery track, the delivery track and the control strip each having a plurality of corresponding windows formed therein. A tube transport carriage is movable along the delivery track between the tube magazine and the interim tube reservoirs and has a magnetically activable tube gripper device arranged to be positively controllable by displacement of the control strip.

As will be appreciated, the present invention has the advantage that the tube feeding device only has a few, relatively sturdy components, essentially comprised of the stationary, horizontally extending track, the control strip displaceably seated along this track, and the tube transport carriage which can be moved along the track. Such a design not only can be expected to have a long service life of the device, but also a good cost/output ratio of the device.

Based on its structural design, tube feeding devices in accordance with the present invention are furthermore distinguished by a high degree of functionality and good availability. The type of control of the tube gripper device arranged on the tube transport carriage in particular has shown itself to be very dependable and almost free of wear. A further advantage of the invention lies in that retrofitting of existing textile machines with the present tube feeding device is possible at any time and with almost no problems.

In a preferred embodiment, the horizontally extending track as well as the control strip are made of a ferromagnetic material, preferably steel. As already indicated above, the track and the control strip have a multitude of windows, whose respective dimensions and distances are matched. The positions of the windows arranged in the stationary track match the spacings of the winding stations of the textile machine which in turn determines the spacings of the storage columns of the central tube magazine. The formation of the track and the control strip of ferromagnetic material makes it possible at any time and in a simple and advantageous manner to create zones, which can be magnetized or unmagnetized, in the area of the interim reservoirs of the winding stations as well as in the area of the storage columns of the central tube magazine which zones, in conjunction with a corresponding permanent magnet package arranged on the tube transport carriage, can be used for a control operation of the tube gripper device. Thus, it is possible, when necessary, to activate a permanent magnet package arranged on the tube transport carriage by the appropriate positioning of the windows of the control strip displaceably along the track and in this manner the tube gripper device of the tube transport carriage can be actuated dependably and rapidly.

In the preferred embodiment, the control strip is connected to a thrust piston which in a customary manner has two end positions respectively corresponding to a first or second control position of the control strip. Therefore, no further control devices are necessary in connection with the positioning of the control strip.

In its first control position, the control strip is preferably positioned in respect to the stationary track such that the windows of the control strip are arranged in registry with the corresponding windows of the horizontally extending track. In this manner, the windows of the track and the windows of the control strip are centered in respect to the storage columns of the central tube magazine and in respect to the interim reservoirs of the winding stations. Thus, in the first control position of the control strip, these areas are always free of ferromagnetic material, so that an unmagnetized zone is provided thereat.

In contrast, in the second control position of the control strip, the control strip is axially displaced in relation to the track such that all windows in the track are completely covered by the control strip, which results in a continuous ferromagnetic zone in the area of the horizontally extending track.

In an advantageous embodiment, the tube transport carriage which is displaceably arranged on the track and which has a magnetically actuable tube gripper device, is connected with a reversible electric drive via a traction means, preferably an endless toothed belt interlockingly guided on a drive pinion of the electric drive. Furthermore, the drive device has a highly resolving sensor device, for example an incremental transducer. Thus, the tube transport carriage can approach the tube pick-up positions in the area of the central tube magazine and/or the tube dispensing positions at the interim tube reservoirs at the winding stations at a high speed, and yet can still be positioned very rapidly and very exactly.

In a preferred embodiment, the tube gripper device of the tube transport carriage comprises two pivotably seated tube manipulation elements, which for example are designed as two-armed gripper arms, connected by means of a spring steel strip such that, with the spring steel strip unloaded, the gripper arms are in a so-called tube pick-up position. In addition, the gripper arms are furthermore acted upon by spring elements in an opening direction.

A permanent magnet package is also preferably fixed in place on the spring steel strip which, in connection with a ferromagnetic opposite pole, can be used for the deflection of the spring steel strip, and thus for closing the tube gripper device. Thus, by way of a magnetically initiated lateral deflection of the spring steel strip, it is possible to move the gripper arms dependably into a closed position in which an empty tube positioned between the gripper arms is securely fixed in place. In the process, use is made of the tendency of the permanent magnet package to always rest against a magnetizable opposite pole, for example the ferromagnetic track or the ferromagnetic control strip. The dimensions of the spring steel strip placed between the gripper arms, as well as its distance to the horizontally extending track, is advantageously selected such that a direct contact between the permanent magnet package and the ferromagnetic opposite pole is dependably prevented.

Further features, advantages and other details of the present invention will be explained and understood from an exemplary embodiment described below with reference to the accompanying drawings.

DETAILED DESCRIPTION OF THE PREFERRED EMBODIMENT

Figure 1:
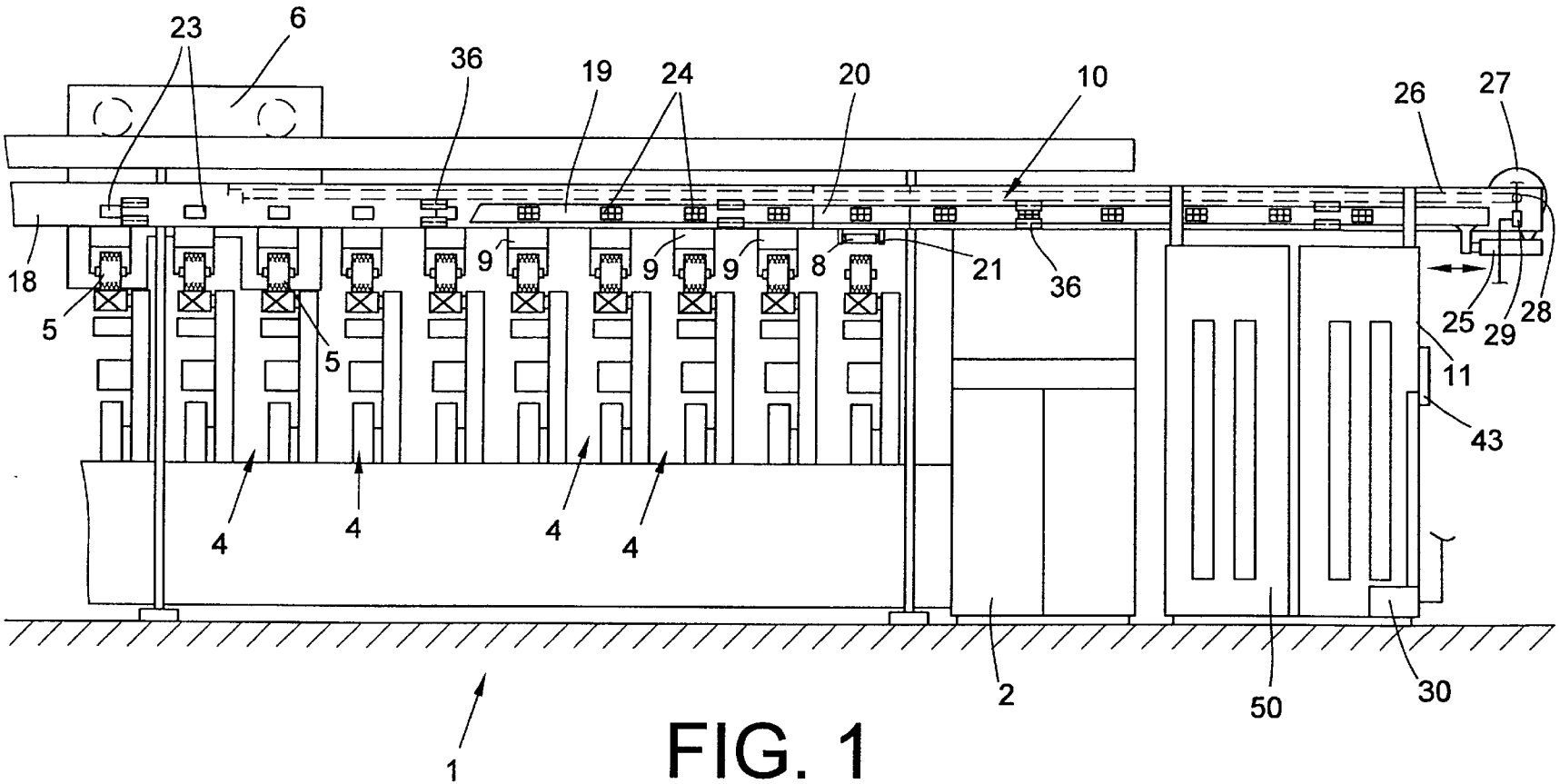
FIG. 1 is a schematic front elevational view of a cheese-producing textile machine, having a tube feeding arrangement in accordance with a preferred embodiment of the present invention.

A winding frame, identified as a whole by the reference numeral 1, is schematically represented in front elevational view in FIG. 1. Such winding frames 1 usually have a number of like winding stations 4 arranged in alignment with one another between their machine end frames 2 and 3 (see also FIG. 2). As is known and therefore not explained in greater detail, spinning cops 22 produced on a ring spinning machine (not shown) are rewound at these winding stations 4 into cheeses 5 of large volume (see also FIG. 3).

The finished cheeses 5 are pushed on a cheese conveyor belt 7 by means of an automatically operating service device, for example by means of a cheese changer 6, and are transported to a tube loading device (not shown) or the like, which is arranged at the end of the machine.

The cheese changer 6 is movably arranged to travel back and forth along the machine above the winding stations 4, and is operative not only to push the fully wound cheeses 5 finished at the winding stations 4 outward onto the cheese conveyor belt 7 but also to automatically transfer an empty winding tube 8 into the winding frame of each respective winding station 4. In the representative winding machine shown, the cheese changer 6 takes each respective empty tube 8 out of an interim reservoir 9 which is part of each respective winding station. The interim reservoirs 9 are connected via a tube conveying device 10 extending over the length of the machine to a central magazine 11 of the winding frame 1 arranged at the end of the machine, by means of which the interim reservoirs 9 are supplied with empty tubes.

Figure 2:
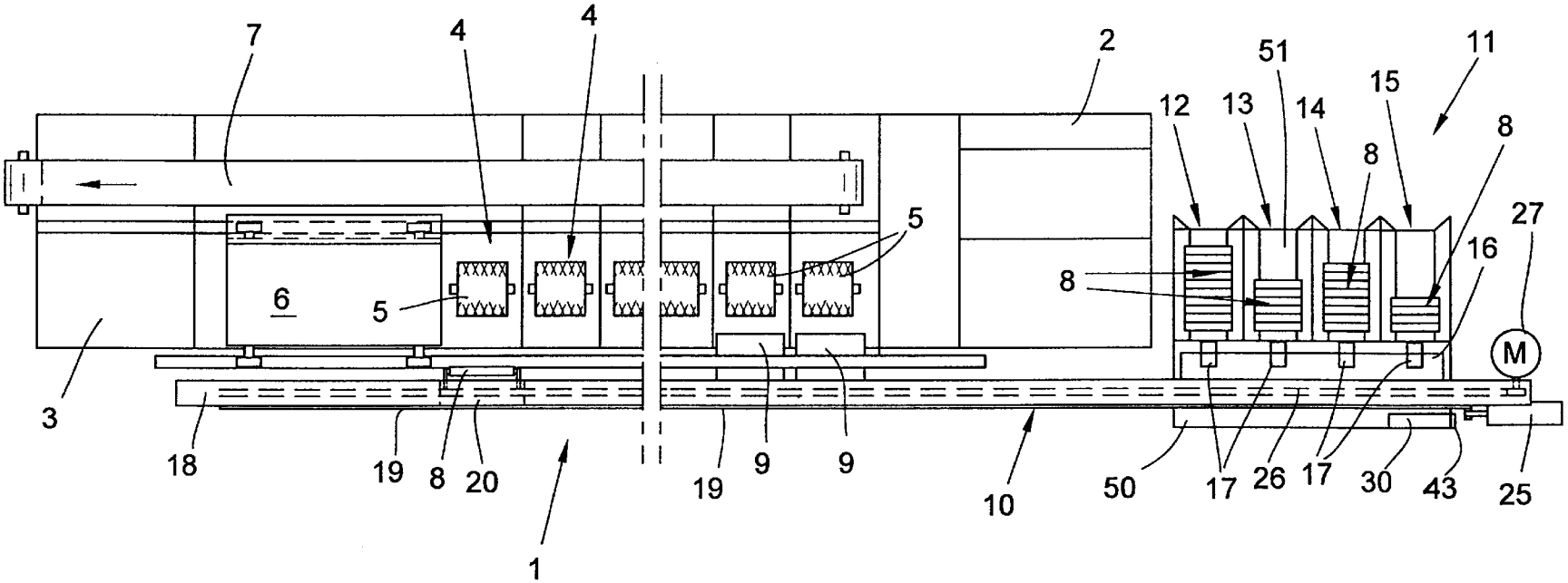
FIG. 2 is a top plan view of the cheese-producing textile machine and the tube feeding arrangement of FIG. 1.
Figure 3:
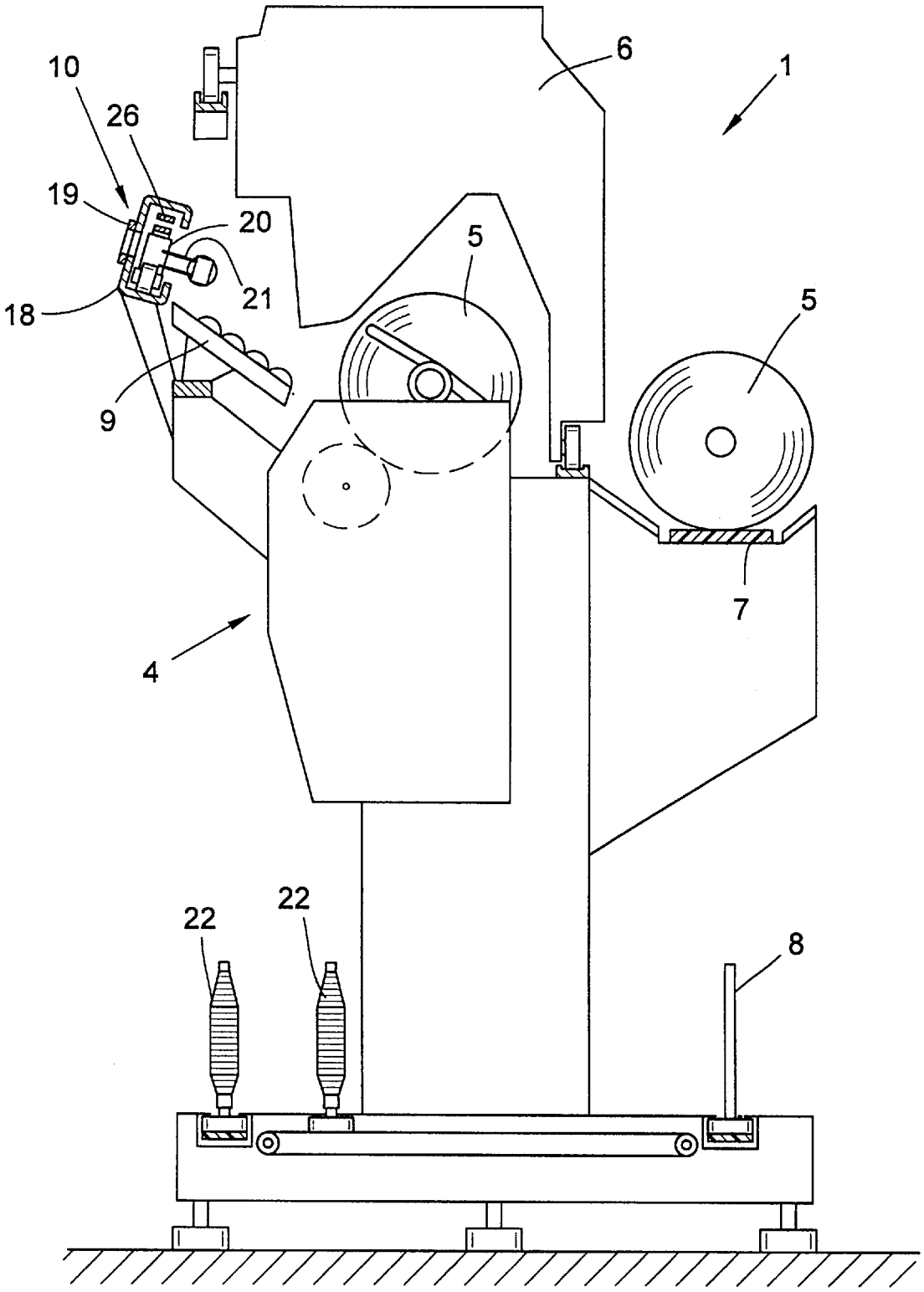
FIG. 3 is an end elevational view of one winding station of the textile machine represented in FIGS. 1 and 2.

The central magazine, represented in its entirety at 11 in FIGS. 1 and 2, essentially comprises a central unit 50 with an integrated control device 30, a vertically displaceable gripper carriage 16, and a storage unit 51, which is fixed on the central unit 50 in an easily exchangeable manner. In the illustrated embodiment, the storage unit 51 has several storage columns 12, 13, 14, 15 arranged next to one other, each such storage column having a number of tube reception rows, sometimes referred to as feed shafts 22, arranged on top of each other for receiving and storing conical and/or cylindrical empty tubes 8.

The central magazine 11 is functionally connected with the tube conveying device 10 by means of the vertically displaceable gripper carriage 16 which, as indicated in FIG. 2, has a positively controllable tube gripper 17 in the area of the storage columns 12 to 15.

The tube conveying device 10 essentially consists of a horizontally extending stationary track 18, a control strip 19 extending alongside the track 18 and arranged to be axially displaced relative to the track 18, and a tube transport carriage 20 arranged for movement along the track 18.

The track 18 is configured in a U-shape cross-section and is made from a ferromagnetic material, for example steel, with a plurality of windows 23 formed at spacings along the length of the track 18. In the illustrated embodiment, the windows 23 are arranged at the same spacing as the winding stations 4 along the winding frame 1, with each window 23 centered with respect to a respective winding station 4 and therefore correspondingly centered in respect to the respective interim tube reservoir 9 arranged thereat. The windows 23 are likewise arranged at the same spacing as, and centered with respect to, the storage columns 12 to 15 of the central magazine 11.

Figure 7:
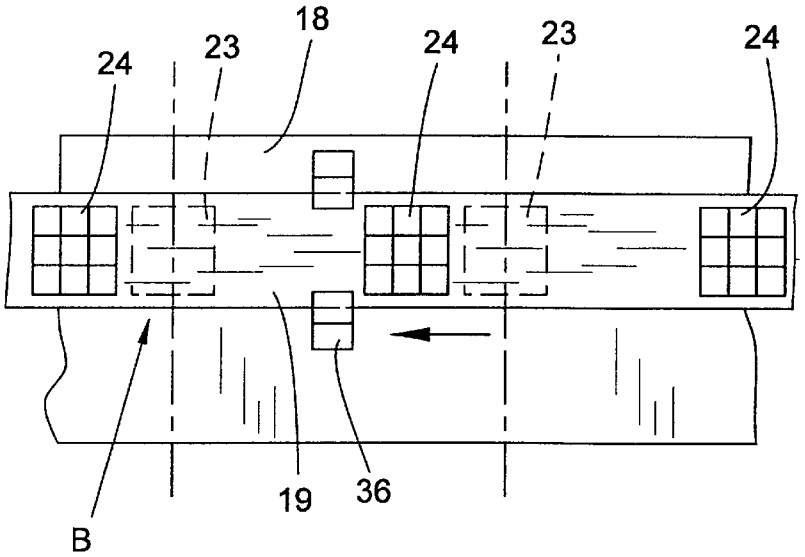
FIG. 7 is another elevational view also taken in the direction X in FIG. 4 showing the track with a control strip positioned in a second control position B.
Figure 6:
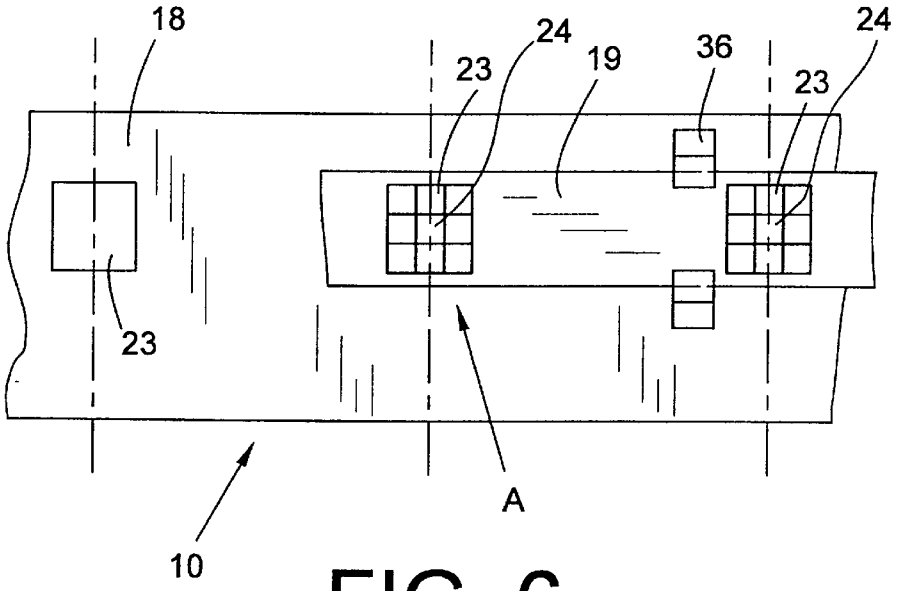
FIG. 6 is an elevational view taken in the direction X in FIG. 4 showing the horizontally extending track with a control strip positioned in a first control position A.

The control strip 19, also made from a ferromagnetic material, has windows 24 which are similarly shaped and of corresponding dimensions and spacings to the windows 23 of the track 18. In addition, for reasons of accident protection, the windows 24 of the control strip 19 are preferably provided with a grid-like finger protector. The control strip 19 is supported within a guide device 36 mounted to the track 18 to be longitudinally displaceable relative to the track 18 by means of a thrust piston 25 between a first control position A and a second control position B (represented in FIGS. 6 and 7).

Figure 4:
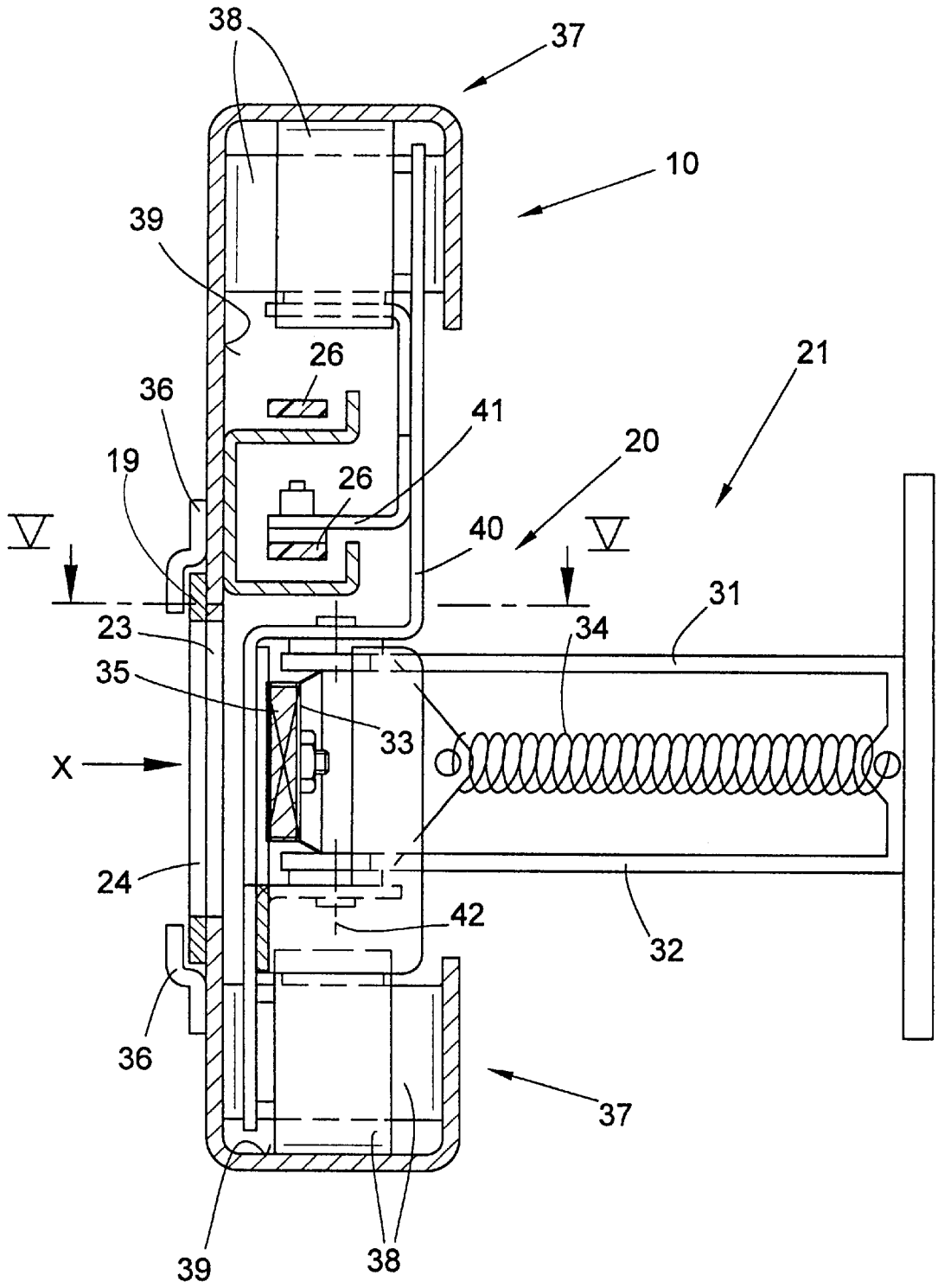
FIG. 4 is a vertical cross-sectional view through the tube feeding arrangement of FIGS. 1–3, taken along the section line IV—IV in FIG. 5, showing the horizontally extending track, the displaceably seated control strip and the tube transport carriage of the tube feeding arrangement.
Figure 5:
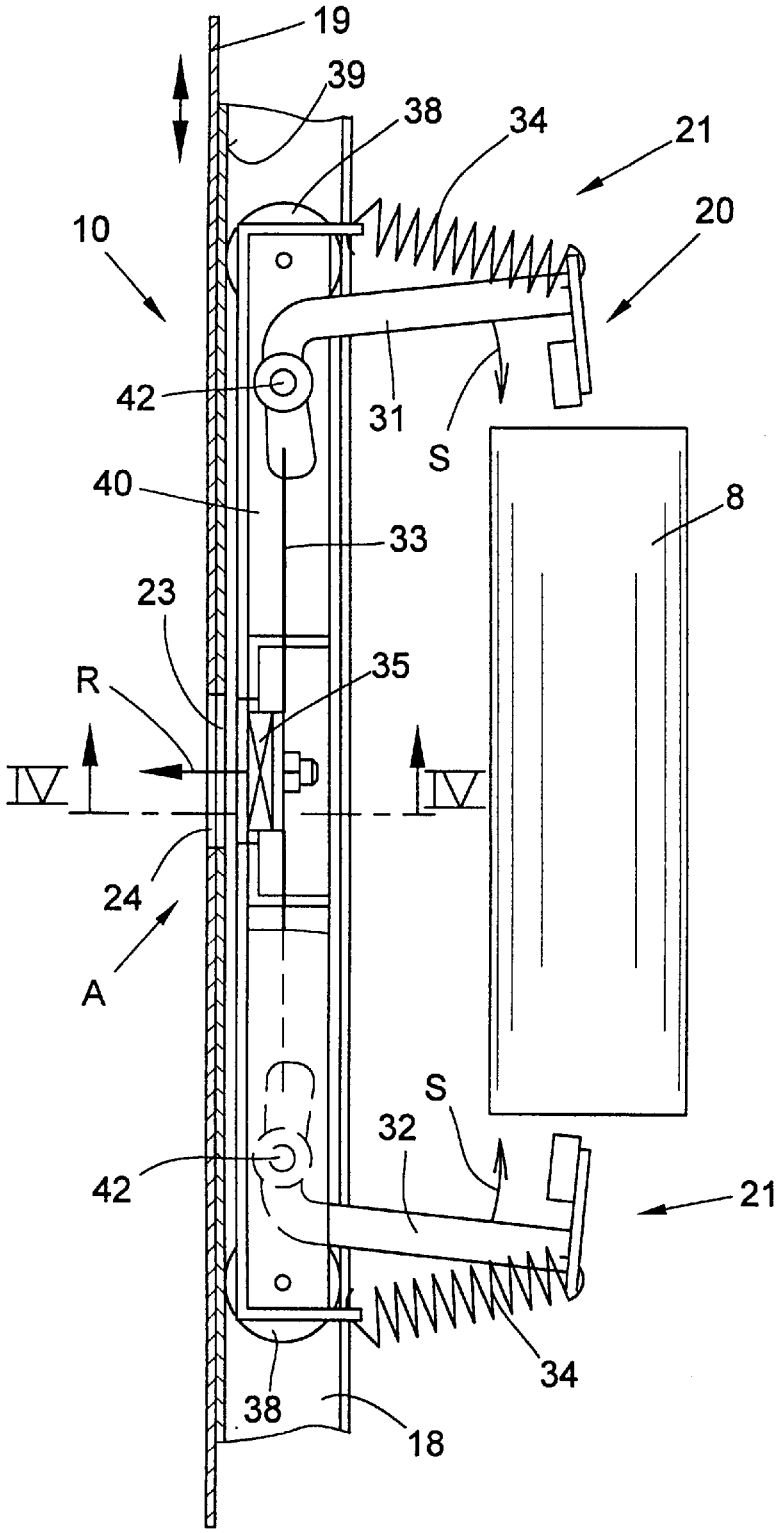
FIG. 5 is a horizontal cross-sectional view through the tube feeding arrangement of FIGS. 1–3, taken along the section line V—V in FIG. 4, showing in top plan view the tube transport carriage thereof.

As seen in FIGS. 4 and 5, the tube transport carriage 20 has an undercarriage 37 having wheels supported on the inner profile 39 of the horizontal track 18 and is connected via a traction device 26, preferably an endless toothed belt, to a reversible electric drive 27. The tube transport carriage 20 is preferably affixed to the endless traction device 26 by a connecting bracket 41, arranged on the undercarriage 40 of the tube transport carriage 20. In addition, a tong-like tube gripper device 21 is fixed in place on the undercarriage 40, and has gripper arms 31, 32 mounted for restricted pivotability in pivot shafts 42.

The gripper arms 31, 32 are preferably angled and connected to one another via a spring steel strip 33, on which a permanent magnet package 35 is fastened. Also, coil spring elements 34 are respectively attached to the gripper arms 31, 32, to act on the gripper arms 31, 32 in an opening direction to urge the arms 31, 32 apart.

The operation of the device may thus be understood. With the winding frame 1 is in a state ready for operation, the storage columns 12 to 15 of the central magazine 11 are filled with empty tubes 8. The control device 30 is set in accordance with the desired charging program via an input keyboard 43 of the central magazine 11.

Thereupon, the tube transport carriage 20 initially moves into a zero, or starting, position in the area of the electric drive 27 and is adjusted thereat by means of a sensor device 29, for example by means of a highly resolving incremental transducer. At the same time, in the central unit 50 of the central magazine 11, the gripper carriage 16 approaches the tube reception row of the central magazine 11 as predetermined by the charging program input to the control device 30 (for example, respectively eight to ten tube reception rows are arranged one above the other per storage column). One of the tube grippers 17 of the gripper carriage 16 removes an empty tube from the selected tube reception row and transfers the empty tube to the tube gripper device 21 of the tube transport carriage 20, which in the meantime has been positioned above the respective storage column 12 to 15 of the central magazine 11.

During this operation, the control strip 19 is in the control position A (see FIGS. 5 and 6), in which the windows 23 of the track 18 and the windows 24 of the control strip are superimposed. Thus, in the control position A, the control strip 19 is shielded by the track 18 from the tube transport carriage 20 and the permanent magnet package 35 arranged on the tube gripper device 21 thereof whereby no opposing ferromagnetic pole is located opposite the permanent magnet package 35 on the tube gripper device 21 of the tube transport carriage 20. Therefore, the permanent magnet package 35 remains deactivated and the spring elements 34 act on the gripper arms 31, 32 to urge them in the opening direction to remain spread apart. In this manner, the tube gripper device 21 of the tube transport carriage 20 is ready for taking over an empty tube 8 in the control position A of the control strip.

As soon as the respective tube gripper 17 of the gripper carriage 16 has moved the tube 8 which was removed from a tube reception row of one of the storage columns 12 to 25 into a position between the gripper arms 31, 32 of the tube gripper device 21 of the transport carriage 20, the control strip 19 is axially displaced into the control position B (see FIG. 7) wherein the windows 23 in the track 18 are completely closed by the ferromagnetic control strip 19.

As a result of the closing of the windows 23 of the track 18, a continuously ferromagnetic, i.e. magnet-activated, zone results in the area of the track 18. The permanent magnet package 35 of the tube transport carriage 20 immediately attempts to place itself against this opposing ferromagnetic pole, so that the spring steel strip 33 is deflected in the direction R (FIG. 5) by the magnetic force of the permanent magnet package 35, and the gripper arms 31, 32 are pivoted toward one another in the direction S. In the process, the gripper arms 31, 32 being pivoted in the direction S grasp the empty tube 8 between them.

Thereafter the tube transport carriage 20 is immediately conveyed at a relatively high speed to the interim tube reservoir 9 of the selected winding station 4 and is positioned thereat exactly above the interim tube reservoir 9. Following this movement, the control strip 19 is returned into the position A, whereby the zone in front of the permanent magnet package 35 of the tube transport carriage 20 is rendered non-magnetizable. As a result, the permanent magnet package 35 loses it opposite ferromagnetic pole, so that the gripper arms 31, 32 are pivoted back into a tube release position by the biasing force of the spring elements 34. Thereupon, the tube 8 falls into the interim tube reservoir 9 of the respective winding station 4.

The tube transport carriage 20 immediately returns to its initial position, i.e. it moves into its zero position in the area of the electric drive 27, whereupon the freshly aligned tube transport carriage 20 is ready for the next tube conveying operation.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a textile machine having a plurality of individual winding stations aligned with one another for producing cheeses of yarn wound on supporting tubes, an arrangement for supplying empty tubes to the winding stations comprising a tube magazine arranged at one end of the plurality of winding stations for storing empty tubes, a plurality of interim tube reservoirs each associated with a respective one of the winding stations, and a conveying device for delivering empty tubes from the tube magazine to the interim tube reservoirs of the winding stations, the conveying device including a tube delivery track extending essentially horizontally over the length of the machine, a control strip displaceably disposed along the delivery track, the delivery track and the control strip each having a plurality of corresponding windows formed therein, a tube transport carriage movable along the delivery track between the tube magazine and the interim tube reservoirs, the tube transport carriage having a magnetically activable tube gripper device arranged to be positively controllable by displacement of the control strip.

2. The tube feeding arrangement in accordance with claim 1, characterized in that the horizontally extending track and the control strip comprise a ferromagnetic material.

3. The tube feeding device in accordance with claim 1, and further comprising a thrust piston for positively displacing the control strip between first and second control positions.

4. The tube feeding device in accordance with claim 3, characterized in that, in the first control position of the control strip, its windows are positioned in registry with the corresponding windows of the track.

5. The tube feeding device in accordance with claim 3, characterized in that, in the second control position of the control strip, all of the windows of the track are covered.

6. The tube feeding device in accordance with claim 1, and further comprising a reversible electric drive and a traction device connecting the tube transport carriage with the reversible electric drive.

7. The tube feeding device in accordance with claim 6, characterized in that the electric drive includes a drive pinion and the traction device comprises an endless toothed belt arranged in toothed engagement with the drive pinion of the electric drive.

8. The tube feeding device in accordance with claim 1, further comprising a sensor device for monitoring the position of the tube transport carriage.

9. The tube feeding device in accordance with claim 1, characterized in that the tube gripper device has two pivotable gripper arms connected by a spring steel strip.

10. The tube feeding device in accordance with claim 9, characterized in that the tube gripper device has a permanent magnet fixed on the spring steel strip.

11. The tube feeding device in accordance with claim 9, characterized in that the tube gripper device has spring elements arranged on the gripper arms to act on the gripper arms in an opening direction.

* * * * *